United States Patent [19]

Suberbielle

[11] Patent Number: 5,050,730

[45] Date of Patent: Sep. 24, 1991

[54] GOLF CLUB STORAGE AND TRANSPORT CONTAINER

[76] Inventor: James E. Suberbielle, Rte. Box 220-6, Jasper, Tex. 75951

[21] Appl. No.: 390,100

[22] Filed: Aug. 7, 1989

[51] Int. Cl.[5] ..... A63B 55/00

[52] U.S. Cl. ..... 206/315.4; 206/315.5

[58] Field of Search ..... 206/315.2–315.8; 280/DIG. 5, DIG. 6; 224/274; 211/70.2; 150/159

[56] References Cited

U.S. PATENT DOCUMENTS

| | | | |
|---|---|---|---|
| 3,059,681 | 10/1962 | Lorbeski | 206/315.4 X |
| 3,460,597 | 8/1969 | Daly | 206/315.4 |
| 3,707,279 | 12/1972 | Kaiser | 206/315.6 X |
| 3,738,677 | 6/1973 | Renock | 280/DIG. 6 X |
| 3,900,209 | 8/1975 | McDonnell | 280/DIG. 6 X |
| 3,941,398 | 3/1976 | Nelson | 280/DIG. 6 X |
| 4,012,051 | 3/1977 | Embinder | 206/315.4 X |
| 4,340,102 | 7/1982 | Isabel | 206/315.6 |
| 4,355,746 | 10/1982 | Casady | 224/274 |
| 4,383,563 | 5/1983 | Kirchhoff, Jr. | 206/315.3 X |
| 4,779,725 | 10/1988 | Gerber | 206/315.4 X |

FOREIGN PATENT DOCUMENTS

| | | | |
|---|---|---|---|
| 2134797 | 8/1984 | United Kingdom | 206/315.3 |

*Primary Examiner*—Sue A. Weaver

[57] ABSTRACT

The golf bag 10 is provided to be used in conjunction with a motorized golf cart 82. The golf bag 10 includes an elonged container 12 which is provided with an upper access opening 16. A cover member 24 is provided to cover the access opening 16 and provide a space between the rear of the golf cart 82 and the container 12. A pivot assembly 26 is provided to couple the cover member 24 to the container 12. When the cover member 24 is pivoted to the first predetermined position between the container 12 and golf cart 82 the access opening 16 is opened and the container 12 is positioned to extend diagonally outwardly from the golf cart 82. This allows access to the golf bag 10 by a user.

8 Claims, 5 Drawing Sheets

GOLF CLUB STORAGE AND TRANSPORT CONTAINER

TECHNICAL FIELD

This invention relates to golfing implements and more particularly to a golf club storage and transport container. That is a golf bag. The sport of golf is ever-growing and is becoming increasingly more popular. As the popularity of the sport grows there is an evergrowing concern to make the sport as time efficient as possible. Traditional golf clubs were transported across a golf course in the golf bag by a caddy. However as the sport has progressed and the need for time savings has increased the motorized golf cart has all but replaced the caddy. As a result less noncompetitive time consumption in relocating from one play position to another is achieved. Accordingly, more time is available for the skill activities associated with the sport. Although the motorized golf cart has been an advantage timewise the transporting location of the golf bag on a typical golf cart creates an undesirable access height. That is it becomes difficult for the golfer to reach the golf clubs to remove them from the bag.

DESCRIPTION OF PRIOR ART

There have been a number of different golf bags developed which provide the utmost convenience to the golfer. However in all the technology that has evolved in this area there has not been a golf bag that addresses the unique problem caused by the advent of the motorized golf cart. That is the undesirable access height created when the golf bag is mounted on the golf cart. Accordingly a solution to this problem is desirable.

DISCLOSURE OF THE INVENTION

A golf bag is provided for use and transporting on a golf cart. The golf bag includes an elongated container having an upper access opening formed therein. A covering and spacing means is provided to allow the access opening in the container to be covered when the covering and spacing means is in a first position. The covering and spacing means also allows the elongated container to be spaced a predetermined diagonal distance from a back portion of the golf cart when the covering and spacing means is in a second position. The golf bag also includes a means for pivotally coupling the covering and spacing means to the container. Accordingly when the covering and spacing means is pivoted to the first position the access opening is covered and when the covering and spacing means is pivoted to the second position the access opening is open. Additionally when the covering and spacing means is in the second position the container is positioned to extend diagonally outwardly from the golf cart thereby achieving a predetermined longitudinal angle to allow access to the container by user.

BRIEF DESCRIPTION OF THE DRAWING

The details of the invention will be described in connection with the accompanying drawing in which.

BEST MODE FOR CARRYING OUT INVENTION

Figure 1:
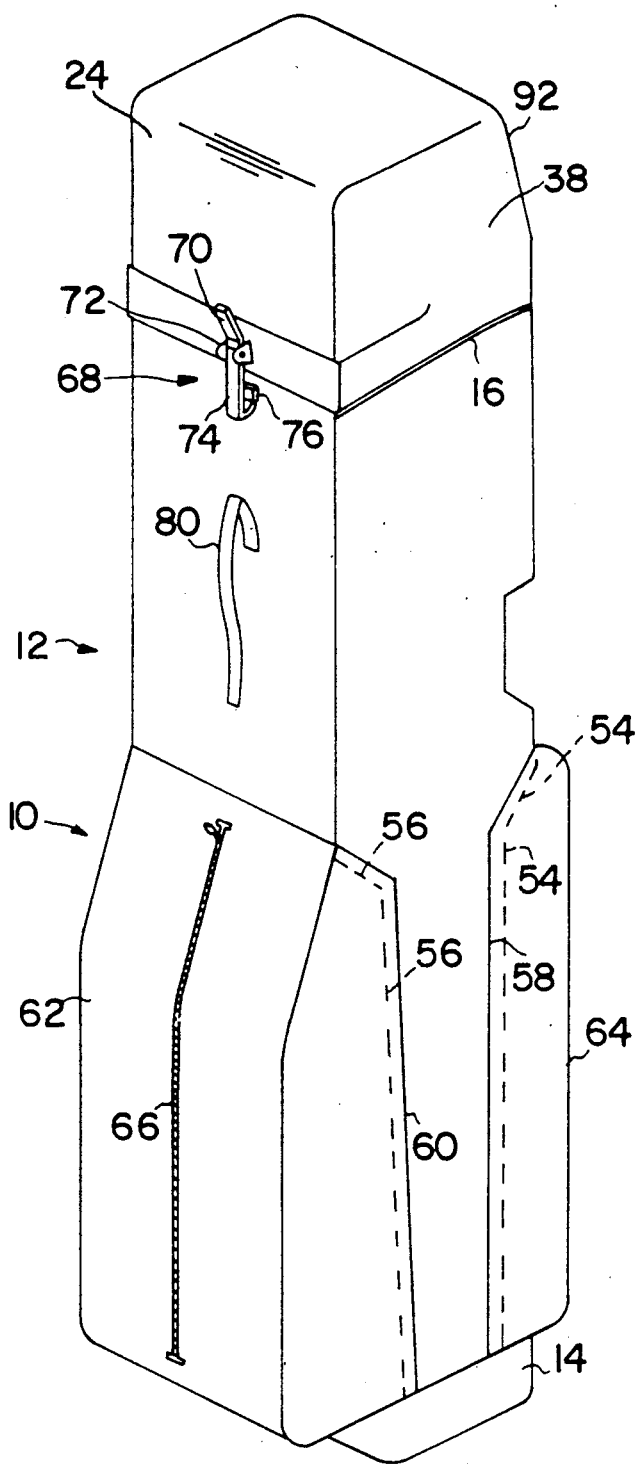
FIG. 1 is a front perspective view of the golf bag in accordance with the principles of the invention.
Figure 2:
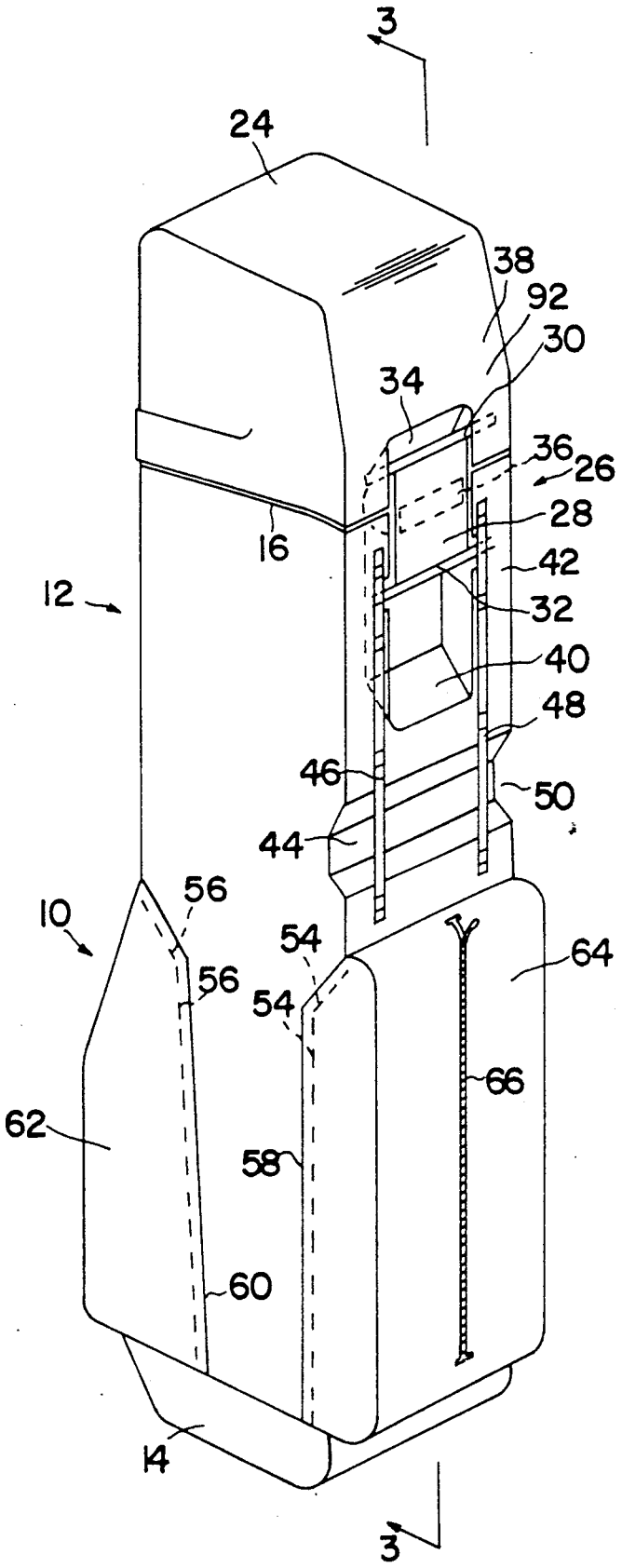
FIG. 2 is a rear perspective view of the golf bag in accordance with the principles of the invention.
Figure 3:
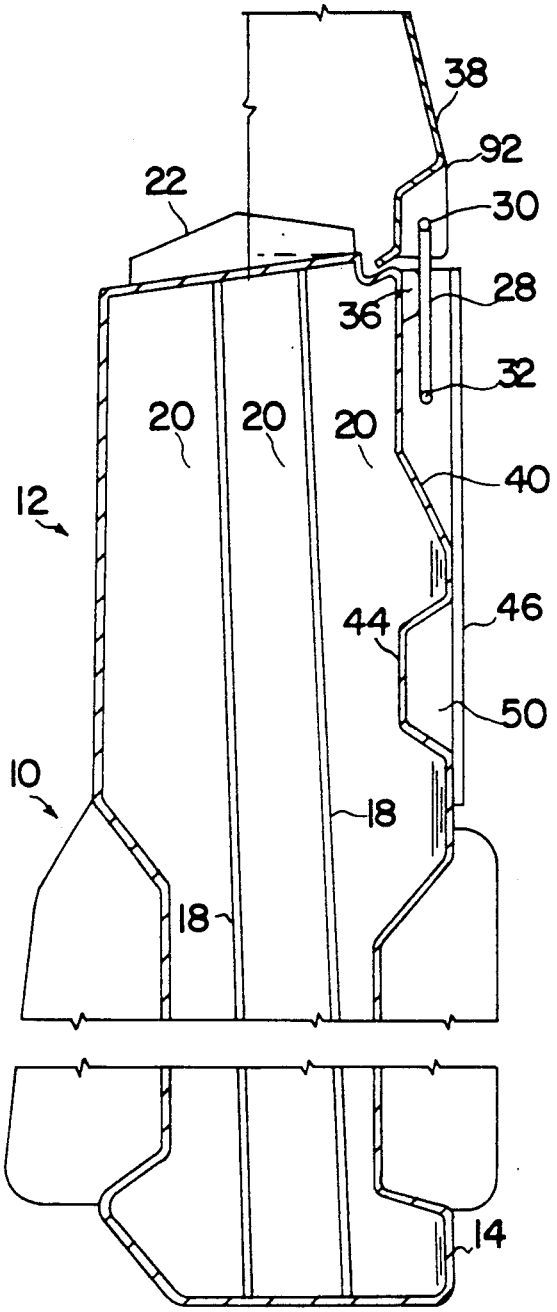
FIG. 3 is a cross sectional view of the golf bag in accordance with the principle of the invention taken along lines 3-3 in FIG. 2.
Figure 4:
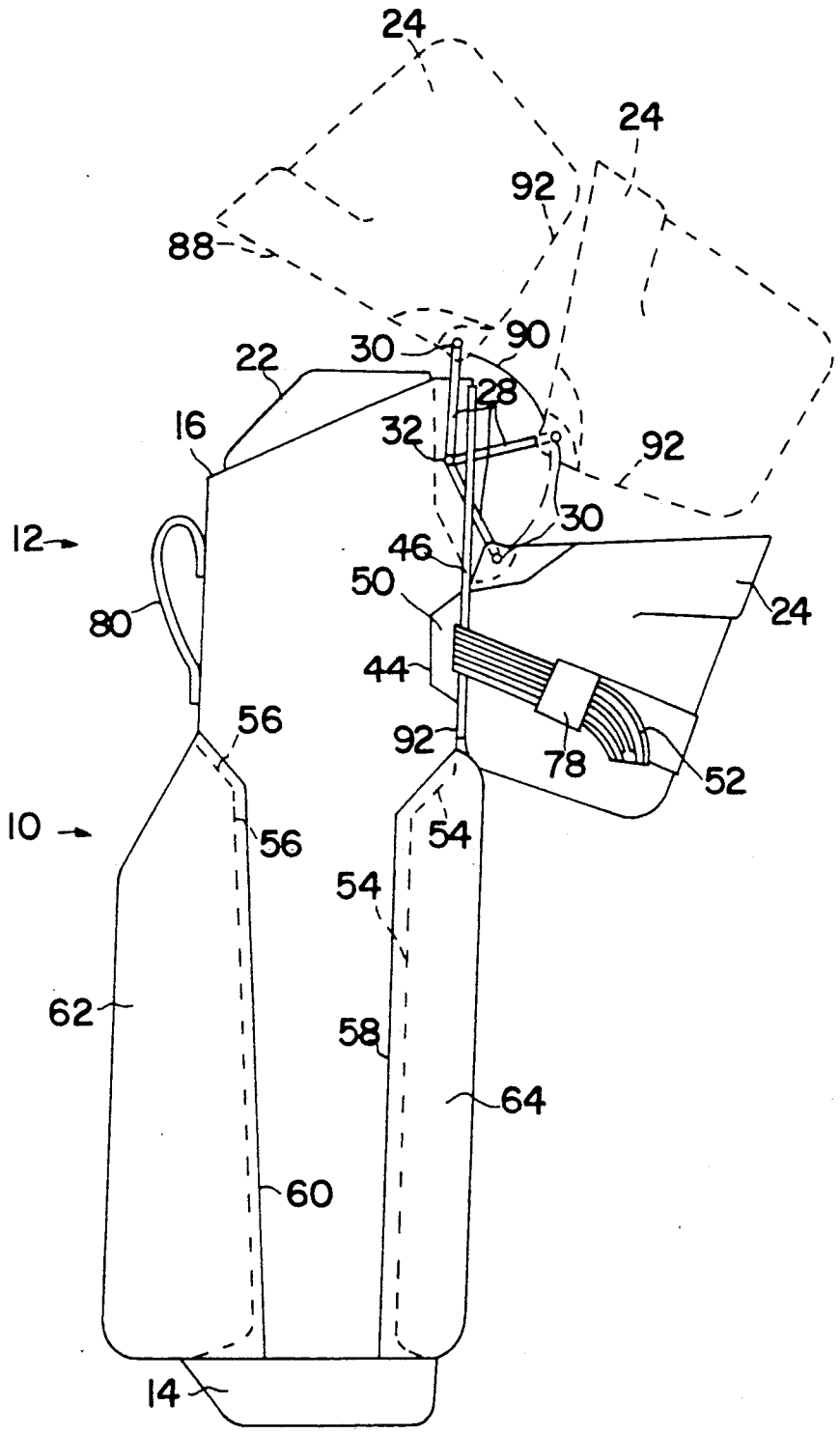
FIG. 4 is side view of the golf bag illustrating the movement of the cover member in accordance with the principles of the invention.

Referring to FIGS. 1 and 2 there is shown, a golf bag, generally designated by the numeral, 10 for storing golf clubs (not shown). The golf bag 10 includes an elongated tubular container, generally designated by the numeral, 12 having a lower closed end 14 and an upper access opening 16 (FIG. 4). The container 12 is provided with a pair of spaced full length dividers 18 which form three compartments 20 in the container for housing different size golf clubs (FIG. 3). The container 12 is also provided with raised upper side members 22 (only one side shown) which maintain the clubs in the proper position in the container.

A cover member 24 is provided to cover the upper access opening 16 of the elongated tubular container 12. The cover member 24 is pivotally coupled to the container 12 by a pivot assembly, generally designated by the numeral, 26. The pivot assembly 26 includes a hinge arm 28 which is provided with pivot pins 30 and 32.

A recessed opening 34 is formed in a in a lower back portion 38 of the cover member 24 (FIG. 3). Pivot pin 30 is pivotally attached to the lower portion 38 of the cover member in the recessed opening 34. Another recessed opening 40, having a raised portion or abutment 36, is aligned with the opening 34 and formed in an upper back portion 42 of the container 12. The pivot pin 32 is attached to the upper portion 42 of the container 12 in the recessed opening 40. The pivot pins 30 and 32 are aligned with and spaced from each other by the hinge arm 28. The hinge arm 28 has upper portions thereof which are aligned adjacent to the abutment 36. The abutment 36 of the recessed opening 40 limits the counterclockwise movement of the hinge arm 28 in the recessed opening 40. This pivot assembly 26 provides the desired opening and closing modes for the cover member 24 with respect to the container 12. The double hinge effect provided by the hinges 30 and 32 and hinge arm 28 allows a cover member opening motion which is an upward, outward and downward (FIG. 4). This assembly 26 also allows a cover member closing motion which is upward, inward, and downward.

The container 12 is also provided with a recessed portion 44. The recessed portion 44 as well as the recessed opening 40 of the container 12 is partially covered by retainer bars 46 and 48. The results of the retainer bars 46 and 48 covering the recessed opening 44 is the creation of an unobstructed passage or opening 50 which receives a retainer strap 52 (FIG. 4) for holding the cover member 24 in a desired open position.

The container 12 is further provided with lower recessed portions 54 and 56 in sides 58 and 60, respectively. These recessed portions allow deep bag type storage pockets 62 and 64 to be provided for transporting large objects, such as, for example, wearing apparel and golfing accessories. The storage pockets 62 and 64 are constructed of a flexible material extending outwardly from the container 12 and are provided with access openings, such as, for example conventional zipper type access openings 66.

A latch assembly, generally designated by the numeral, 68 is provided to securely couple the cover member 24 in a closed position adjacent container 12. The latch 68 is provided with an arm 70. The arm 70 is pivotally coupled at an intermediate portion thereof to the cover member 24 by a pivot pin 72. The arm 70 has a hook portion 74 formed at a lower portion thereof. The hook 74 is provided to engage a coupling member 76 on the container 12. When the arm 70 is pivoted counterclockwise the hook 74 engages the coupling member 76 to couple the cover member 24 and container 12 together. Likewise when the arm 70 is pivoted clockwise the hook 74 is released from the coupling member 76 thereby allowing the cover member 24 to be moved away from the container 12. A handle 80 is coupled to the front of the container 12 to allow manual manipulation of the golf bag 10.

Figure 5:
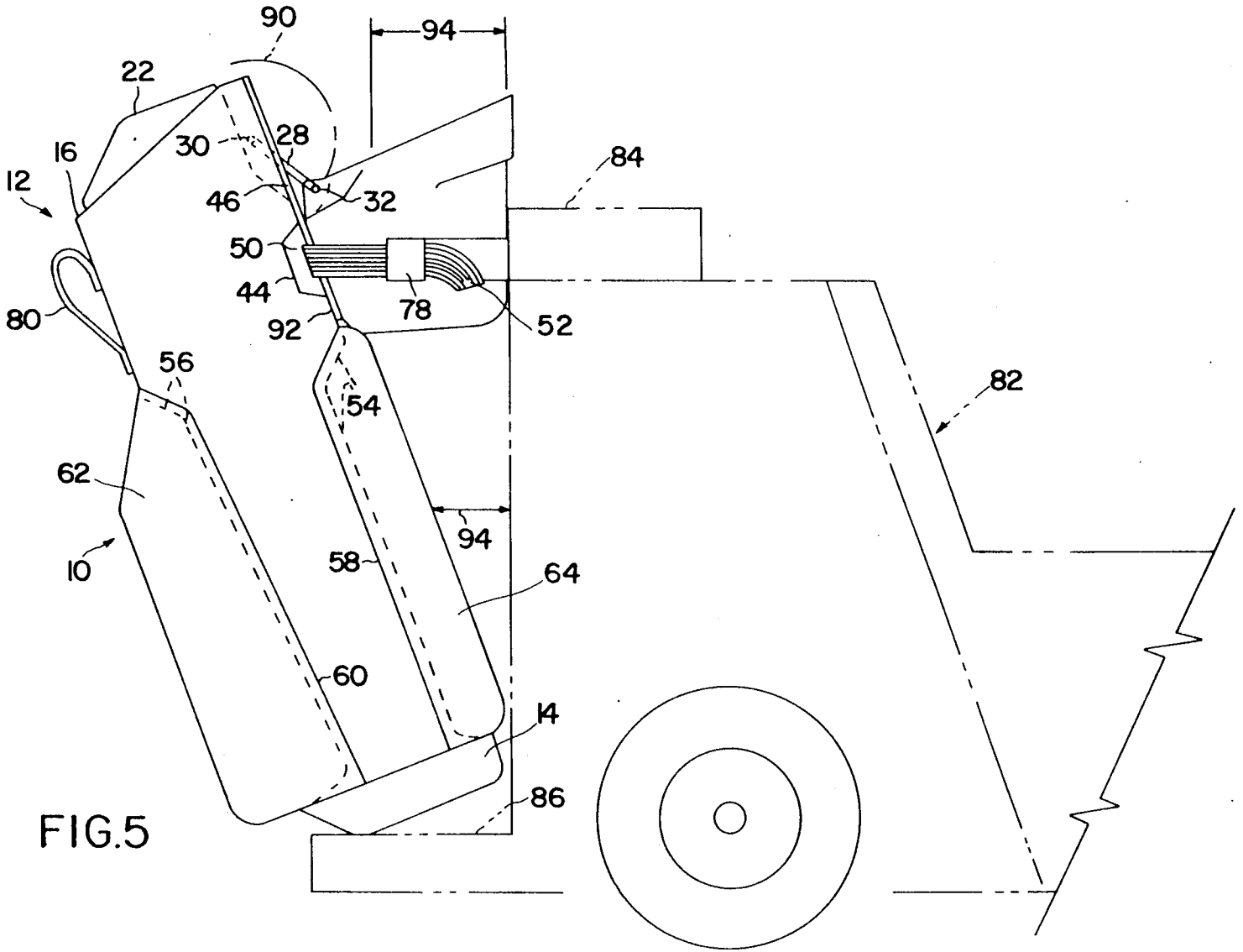
FIG. 5 is another side view of the golf bag supported on a typical motorized golf cart in accordance with the principles of the invention.

As illustrated in FIG. 5, when in use, the golf bag 10 is mounted on a typical motorized golf cart generally designated by the numeral, 82. The golf bag 10 is mounted on the golf cart 82 adjacent to and in alignment with a golf cart retaining bracket 84 on rear support 86 of the cart. The golf cart 82 is provided with a latch 78. The latch 78 is provided to receive and hold the strap 52 so that the cover member 24 can be held securely in a desired position (FIG. 4). When the cover member 24 is pivoted open the pivot assembly 26 allows the cover member 24 to first move upward at portions 88 thereof then move outward and then downward as illustrated in FIG. 4. The arc line 90 illustrates the path of travel of cover member 24. As a result the back wall 92 of cover member 24 is parallely aligned adjacent outside portions of the retaining bars 46 and 48 on the container 12. The cover member 24 can then be secured in position by positioning the strap 52 in the recessed opening 50 and through the appropriate latch 78. When the cover member 24 is positioned between the golf cart 82 and the container 12 a predetermined diagonal spacing 94 is provided by the cover member that positions the access opening 16 diagonally outwardly from the golf cart 82. This facilitates a desirable the longitudinal access angle that permits a golfer (not shown) to reach the golf clubs (not shown) in the golf bag 10 although they are in a higher position on the golf cart 82.

It should be understood that various changes and modifications can be made without departing from the spirit of the invention as defined in the claims.

What is claimed:

1. A golf bag to be used and transported on a golf cart including:

an elongated container having an upper access opening formed therein, a first recessed portion formed in an upper portion of the elongated container, and a second recessed portion aligned under and adjacent to the first recessed portion;

means for covering the access opening of the container when in a first position and for spacing the container a predetermined diagonal distance from a back portion of the golf cart when in a second position, the covering and spacing means including a recessed portion formed in a lower portion thereof, aligned above and adjacent to the first recessed portion in the elongated container;

means for pivotally coupling the covering and spacing means to the container so that when the covering and spacing means is pivoted to the first position the access opening in covered and so that when the covering and spacing means is pivoted to the second position the access opening is open and the container is positioned to extend diagonally outwardly from the golf cart thereby achieving a predetermined longitudinal angle to allow access to the container by the user; and an abutment formed at an upper portion of the first recessed portion.

2. A golf bag as defined in claim 1 wherein the coupling means includes:

a first pivot pin mounted in the recessed portion of the covering and spacing means;

a second pivot pin spaced from and aligned with the first pivot pin and mounted in the first recessed portion in the elongated container; and a hinge arm having upper portions thereof pivotally coupled to the first pivot pin and lower portions thereof pivotally coupled to the second pivot pin so that the covering and spacing means can be pivoted to the first and second positions.

3. A golf bag as defined in claim 2, wherein the hinge arm is aligned in the first recessed portion in the elongated container so that intermediate portions thereof engage the abutment to thereby facilitate a predetermined counterclockwise movement of the hinge arm.

4. A golf bas as defined in claim 5 wherein the elongated container further includes a pair of retainer bars coupled over the second recessed portion in spaced alignment therewith to thereby create an unobstructed opening between the second recessed portion and the retainer bars.

5. A golf bag as defined in claim 1 wherein the covering and spacing means further includes:

a retainer strap; and a latch couplable to the retainer strap, the retainer strap being alignable behind the retainer bars in the opening between the second recessed portion of the elongated container and the retainer bars to engage the latch and thereby couple the covering and spacing means in a predetermined position between the elongated container and a back portion of the golf cart.

6. A golf bag as defined in claim 5 wherein the elongated container further includes:

a third recessed portion formed in a lower portion of the elongated container in alignment with the second recessed portion; and a first storage member having an access opening therein coupled to the elongated container in the third recessed portion.

7. A golf bag as defined in claim 6 wherein the elongated container further includes:

a fourth recessed portion formed in a lower portion thereof; and a second storage member having an access opening therein coupled to the elongated container in the fourth recessed portion.

8. A golf bag as defined in claim 7 further including a coupling member for coupling the covering and spacing means to the elongated container.

* * * * *